US008820526B1

(12) United States Patent
Cooney

(10) Patent No.: US 8,820,526 B1
(45) Date of Patent: Sep. 2, 2014

(54) SAFETY RAZOR ASSEMBLY HAVING FACIAL FEATURES

(76) Inventor: Sean Joseph Cooney, East Hartford, CT (US)

( * ) Notice: Subject to any disclaimer, the term of this patent is extended or adjusted under 35 U.S.C. 154(b) by 125 days.

(21) Appl. No.: 13/573,291

(22) Filed: Sep. 7, 2012

Related U.S. Application Data

(60) Provisional application No. 61/626,443, filed on Sep. 27, 2011.

(51) Int. Cl.

| | |
|---|---|
| ***B65D 73/00*** | (2006.01) |
| ***B26B 21/06*** | (2006.01) |
| ***B65D 85/00*** | (2006.01) |
| ***B65D 79/00*** | (2006.01) |

(52) U.S. Cl.
CPC ..... *B65D 85/00* (2013.01); *B65D 79/00* (2013.01)
USPC ..... 206/354; 30/32; 30/526; 206/457

(58) Field of Classification Search
USPC ..... 206/208, 351–360, 457, 459.5; 30/32, 30/526, 532
See application file for complete search history.

(56) References Cited

U.S. PATENT DOCUMENTS

| | | | | |
|---|---|---|---|---|
| 2,534,861 | A * | 12/1950 | Foltis | 30/526 |
| 2,648,129 | A * | 8/1953 | Streeter | 30/526 |
| 2,665,003 | A * | 1/1954 | Feigelman | 206/457 |
| 4,167,059 | A * | 9/1979 | Iten | 30/32 |
| 6,635,332 | B1 * | 10/2003 | McArthur | 206/352 |
| 6,823,594 | B2 * | 11/2004 | Kludjian et al. | 30/526 |
| 8,083,058 | B2 * | 12/2011 | Marcinkowski et al. | 206/352 |
| 2010/0213098 | A1 * | 8/2010 | Tomasello et al. | 206/457 |

* cited by examiner

*Primary Examiner* — Luan K Bui
(74) *Attorney, Agent, or Firm* — Ira S. Dorman

(57) ABSTRACT

A unique and fanciful packaging assembly consists of at least one safety razor having a disc-like handle and an attached, generally tangential blade-holding head, the razor or razors being arranged in various combinations, and with optional enhancements, so as to simulate a face.

6 Claims, 2 Drawing Sheets

SAFETY RAZOR ASSEMBLY HAVING FACIAL FEATURES

CROSS REFERENCE TO RELATED APPLICATION

This application claims the benefit of U.S. Provisional patent Application No. 61/626,443, filed Sep. 27, 2011, the entire specification of which is incorporated hereinto, by reference.

BACKGROUND OF THE INVENTION

A novel form of safety razor has recently been developed by the present inventor, consisting of an elongated blade-holding head and a disc-like handle proximately joined to one another. It is of course highly desirable to provide unique, attractive, and functional packaging for any such product, so as to promote consumer appeal and convenience, and sales.

SUMMARY OF THE INVENTION

It is an object of the present invention to provide a unique packaging assembly comprised of at least one safety razor having an elongate blade-holding head and a proximately joined handle of disc-like form.

A more specific object of the invention is to provide such a packaging assembly having facial features.

Further specific objects are to provide such an assembly wherein one, two, or three razors may be presented, and secured by means that may permit replacement after use of the razor, wherein the image of a famous person, an animal, a fictional character, or the like, may be simulated, and wherein the assembly is adapted for convenient mounting for use and/or display.

It has now been found that the foregoing and related objects of the invention are attained by the provision of a safety razor assembly, having a face-like appearance, comprising human head-simulating support means and at least one safety razor effectively mounted on the support means. The safety razor comprises a disc-like handle and an elongated blade-holding head proximately attached to the handle so as to extend generally tangentially thereto and generally in a plane thereof. The razor is positioned on the support means so as to cause the razor head and handle, respectively, to simulate either an eye and an associated eyebrow, or a mouth and a nose.

The support means will desirably include a tray having a recess in which the razor is contained, and a panel removably seated in the recess, with a clear, or substantially transparent, cover spanning an open top of the recess; the cover may bear graphics or images arranged to cooperate with the razor for facial feature simulation. The assembly will also desirably include means of attachment for removably and replaceably engaging the razor so as to mount it on the support means.

In preferred embodiments, the assembly will comprise a plurality of razors effectively mounted on the support means, at least one of which razors is positioned on the support means so as to cause the head and the handle thereof, respectively to simulate either an eye and an associated eyebrow or a mouth and a nose, and another of which razors is positioned on the support means so as to cause the head and the handle thereof, respectively, to simulate an eye and an associated eyebrow.

Most desirably, the assembly will comprise three of the razors, effectively mounted on the support means, two of the razors being positioned on the support means so as to cause the head and the handle of each to simulate, respectively, an eye and an associated eyebrow, and the third one of the razors being positioned on the support means so as to cause the head and the handle thereof simulate, respectively, a mouth and a nose.

DETAILED DESCRIPTION OF THE PREFERRED AND ILLUSTRATED EMBODIMENTS

Figure 1:
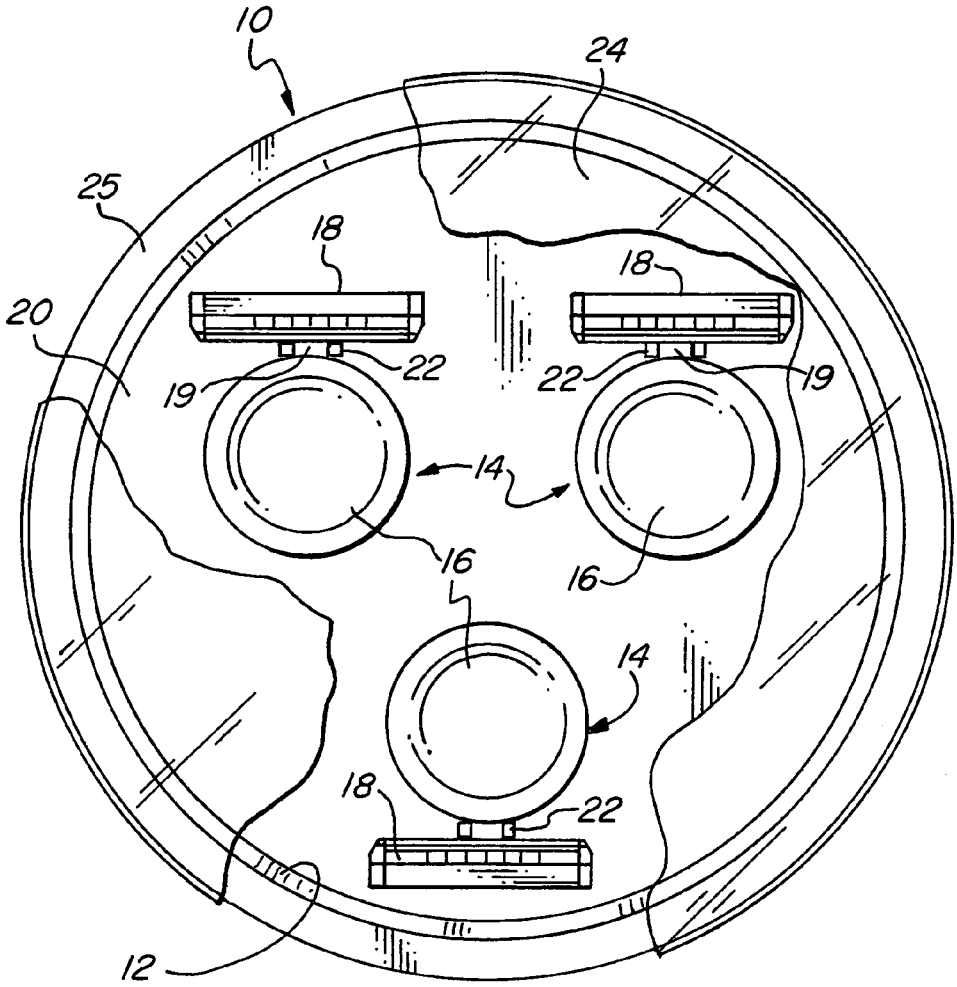
FIG. 1 is a plan view of a safety razor assembly embodying the present invention.

Turning initially to FIG. 1 of the drawings, therein illustrated is a safety razor assembly that includes a tray 10 (such as may be molded from plastic), having a recess 12 formed thereinto. Contained in the recess 12 are three safety razors, each generally designated by the numeral 14 and consisting of a handle 16, of disc-like form, and a blade-mounting head 18, which is proximately attached to the handle 16 by a short throat element 19 so as to extend generally tangentially and in the plane of the handle 16. The razors 14 are disposed against a bottom wall 20 of the tray 10, which wall 20 is formed to have three, integral pairs of upstanding bosses forming clip fasteners 22 by which the throat elements 19 of the razors 14 are removeably and replaceably engaged. A clear film cover 24 (fragmentarily illustrated) spans the open top of the recess 12 and is secured to the peripheral flange 25 that surrounds the tray 10, so as to overlie the recess 12 and complete the package.

As will be appreciated, the tray 10 of the package simulates a human head. The upper two razor handles 16 simulate eyes, the upper two razor heads 18 simulate eyebrows, the lower handle 16' simulates a nose, and the lower head 18' simulates a mouth.

Thus, as can be seen in FIG. 1 the handles 16 of the three razors 14 are proximate to one another. The handle 16 of the razor at the bottom of the figure (a "first" razor) is positioned on a central axis of the wall 20 of the tray 10, with its head 18 extending transversely of the central axis, thereby causing the handle 16 of that razor to simulate a nose and the causing the head 18 thereof to simulate a mouth. The heads 18 of the two razors 14 at the top of the figure (a "second" and a "third" razor) are distal from the head 18 of the first razor and the second and third razors at the top are laterally offset in opposite directions from the central axis on which the handle 16 of the first razor is positioned. The handles 16 of the second and third razors therefore simulate two eyes, and the heads 18 thereof simulate associated eyebrows.

Figure 2:
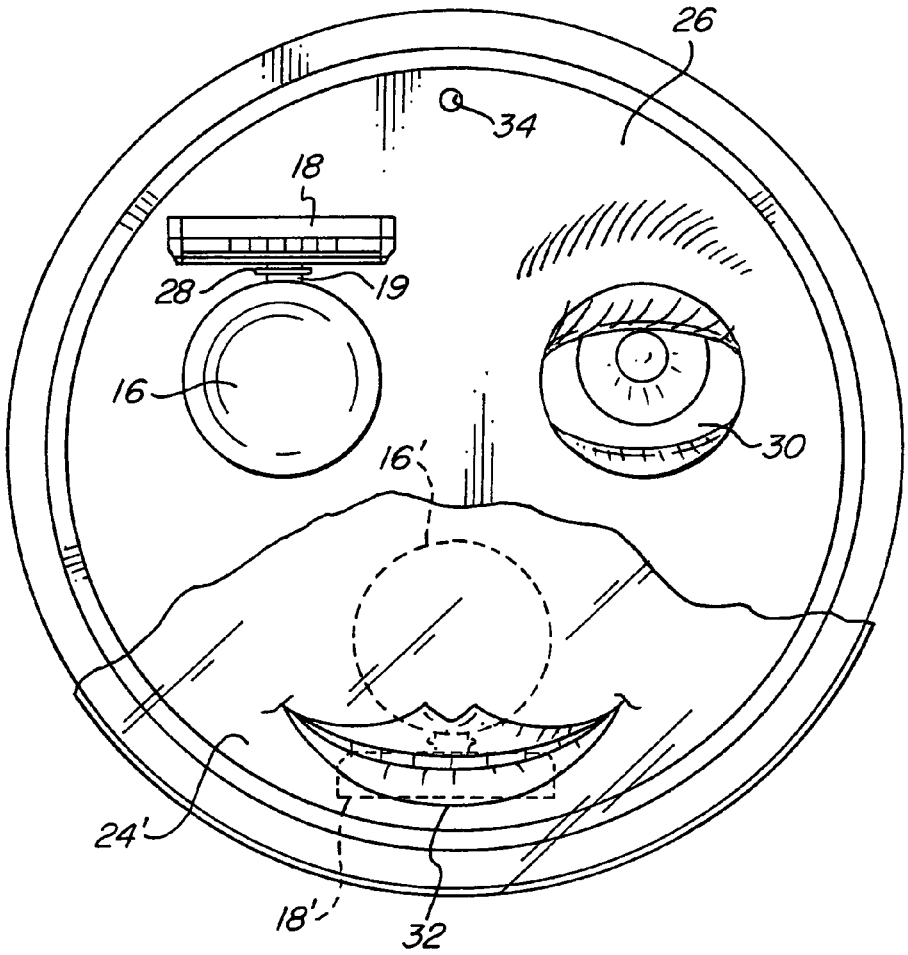
FIG. 2 is a plan view of a second embodiment of the assembly.

The assembly of FIG. 2 is similar to that of FIG. 1 but varies, firstly, by including only two razors 14, one of which, comprised of handle 16' and head 18', is located beneath the illustrated fragment of a clear, spanning film cover 24'. The assembly also includes a panel, or hang card, 26, which is removably seated in the tray 10 and to which the razors 14 are attached by staples or wires extending about the throat elements 19; needless to say, other means of attachment, such as adhesive bonding, may be employed if so desired.

In the embodiment of FIG. 2, the simulated mouth, provided by the razor head 18', is enhanced by superimposing an image of lips 32 printed upon the film cover 24' in substantially overlying, aligned relationship. As a further augmentation (among many others that can obviously be made), an iris and/or pupil (not illustrated) could be applied to a section of covering sheet or film overlying an eye-simulating handle.

The presence of a second eye is indicated in the present embodiment by an image 30 printed directly upon the surface of the panel 26, and here again many other directly applied features may be included. Ear-like appendages, hats, and the like may also be attached to a tray, panel, or backing board, which itself may be of a shape other than round. A centrally positioned small aperture 34 is formed through the "forehead" of the "face" on the panel 26 so as to readily permit the removed panel to be hung on a hook or the like for use and/or display in a shower, on a wall, etc.

Thus, it can be seen that the present invention provides a unique packaging assembly comprised of at least one safety razor having an elongate blade-holding head (which may or may not be loaded with one or more blades, at the point of sale) and a proximately joined handle of disc-like form, which assembly, more specifically, provides a packaging assembly having facial features. One, two, or (in most cases preferably) three razors may be included, and securement of the razors may be effected by means that permits replacement after use; the facial features may simulate the image of a famous person, an animal, a fictional character, etc., and many enhancements and augmentations may be incorporated. Finally, it will be appreciated that the handles of the razors may themselves be decorated; such decoration may, for example, depict the cornea and/or iris of an eye, to promote the facial theme; sports themes may be suggested by printing and/or embossing baseball cover stitching or the soccer ball hexagon pattern thereon; etc.

What is claimed is:

1. A safety razor packaging assembly having a face-like appearance, comprising human head-simulating support means including a wall or panel, and a plurality of razors effectively mounted on, and disposed against, said wall or panel of said support means, each of said razors comprising a disc-like handle and an elongated blade-holding head proximately attached to said handle, by a short throat element, so as to extend generally tangentially thereto and generally in a plane thereof, said plurality of razors being arranged on and against said wall or panel of said support means with said handles thereof proximate to one another and said heads of a first one of said razors and a second one of said razors distal from one another; said handle of said first one of said razors being positioned on a central axis of said support means and said head of said first one of said razors extending transversely of said central axis so as to cause said head and said handle of said first one of said razors to simulate, respectively, a nose and a mouth, said handle and said head of said second one of said razors being positioned laterally offset from said central axis so as to cause said head and said handle of said second one of said razors to simulate an eye and an associated eyebrow, respectively.

2. The assembly of claim 1 wherein said support means includes a tray providing a bottom wall, and a recess in which said plurality of razors are contained, and wherein said assembly additionally includes a substantially transparent cover spanning an open top of said recess.

3. The assembly of claim 2 wherein said substantially transparent cover bears graphics arranged thereon to cooperate with at least one of said plurality of razors for facial feature simulation.

4. The assembly of claim 2 wherein said support means includes a panel removably seated in said recess of said tray.

5. The assembly of claim 1 additionally including means for removably and replaceably engaging said plurality of razors so as to mount said plurality of razors on said support means.

6. The assembly of claim 1 where said assembly comprises a third one of said razors effectively mounted on, and disposed against, said wall or panel of said support means, said handle of said third one of said razors being proximate to said handles of said first one of said razors and said second one of said razors, and said head of said third one of said razors being distal from said head of said first one of said razors, said third one of said razors being positioned laterally offset from said central axis in a direction opposite to the direction of lateral offset of said second one of said razors so as to cause said head and said handle of said third one of said razors to simulate, respectively, a second eye and associated eyebrow.

* * * * *